US005133476A

United States Patent [19]

Schutz

[11] Patent Number: 5,133,476

[45] Date of Patent: Jul. 28, 1992

[54] PALLET CONTAINER

[76] Inventor: Udo Schutz, Ruckersteg 4, D-5418 Selters, Fed. Rep. of Germany

[21] Appl. No.: 716,237

[22] Filed: Jun. 17, 1991

[30] Foreign Application Priority Data

Jun. 15, 1990 [DE] Fed. Rep. of Germany ..... 4019042

[51] Int. Cl.[5] ..... B65D 19/00

[52] U.S. Cl. ..... 220/622; 220/1.5; 220/402

[58] Field of Search ..... 220/658, 1.5, 4.12, 220/4.13, 401, 402, 622, 408

[56] References Cited

U.S. PATENT DOCUMENTS

| | | | |
|---|---|---|---|
| 1,192,538 | 7/1916 | Leslie | 220/622 |
| 1,348,354 | 8/1920 | Garnett et al. | 220/622 X |
| 2,877,923 | 3/1959 | Perez | 220/622 X |
| 4,795,057 | 1/1989 | Jungels et al. | 220/401 |
| 4,909,387 | 3/1990 | Schutz | 220/485 X |
| 4,947,988 | 8/1990 | Schutz | 220/401 X |

FOREIGN PATENT DOCUMENTS 3418301 11/1990 Fed. Rep. of Germany .

*Primary Examiner*—Steven M. Pollard
*Attorney, Agent, or Firm*—Young & Thompson

[57] ABSTRACT

The pallet container (1), developed with the intended objective of simplifying the lid fastening feature as compared with conventional containers, with an inner container (2) of a synthetic resin and with a sheet-metal jacket (3) in close contact with this inner container, this jacket being attached to a flat pallet (16), is characterized in that the upper rim of the sheet-metal jacket (3) is designed as a triple folded rim (14) to which the lid (4) is attached by threaded fasteners.

5 Claims, 2 Drawing Sheets

PALLET CONTAINER

The invention relates to a pallet container of a synthetic resin for liquids, with respectively one closable filling opening and outlet opening, this container being surrounded by a carrying framework for stacking purposes, this framework consisting of a casing in close contact with the synthetic-resin container and exhibiting a sheet-metal jacket with threaded-on lid and a bottom, the casing being attached to a flat pallet, wherein cutouts in the casing permit access to the filling opening and outlet opening of the container.

In such a pallet container, known from DE 3,418,301 Al, the lid is detachably fastened to the four linear upper marginal sections of the container jacket by way of omega-shaped sheet-metal profile strips by means of screws and nuts. The mounting of the lid to the sheet-metal jacket by means of four profiled sheet-metal strips which must be manufactured separately is relatively expensive.

Another pallet container of the type of interest herein, available on the market, has a rectangular sheet-metal jacket wherein the lid is threaded, by way of a continuously extending sheet-metal profile strip having a hairpin profile, to the sheet-metal jacket, the latter being produced by stretching a longitudinally welded sheet-metal pipe with a profiled ring attached by spot welding to the upper pipe rim. Although this arrangement represents a simplification as compared with the pallet container according to DE 3,418,301 Al, a sheet-metal profile strip to be manufactured separately is still required herein, this strip being welded fixedly to a longitudinal rim of the rectangular sheet-metal blank as the starting material for the pipe to be stretched.

The invention is based on the object of further simplifying the lid mounting of the pallet container of the type discussed herein, with a view toward a more economical series production.

The pallet container of this invention represents a simple and advantageous solution of the posed problem.

The invention will be described in greater detail below with reference to the drawings wherein.

Figure 1:
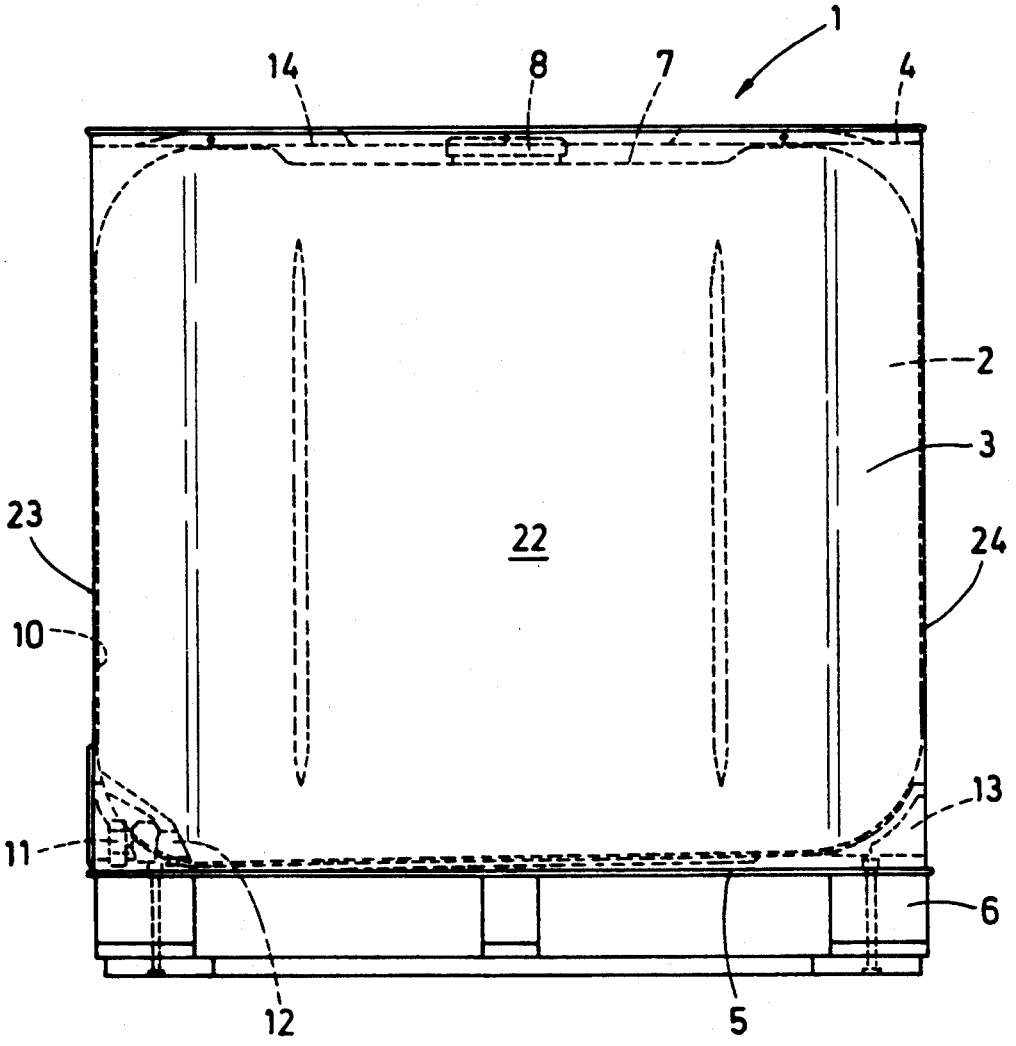
FIG. 1 is a lateral view of a pallet container.
Figure 2:
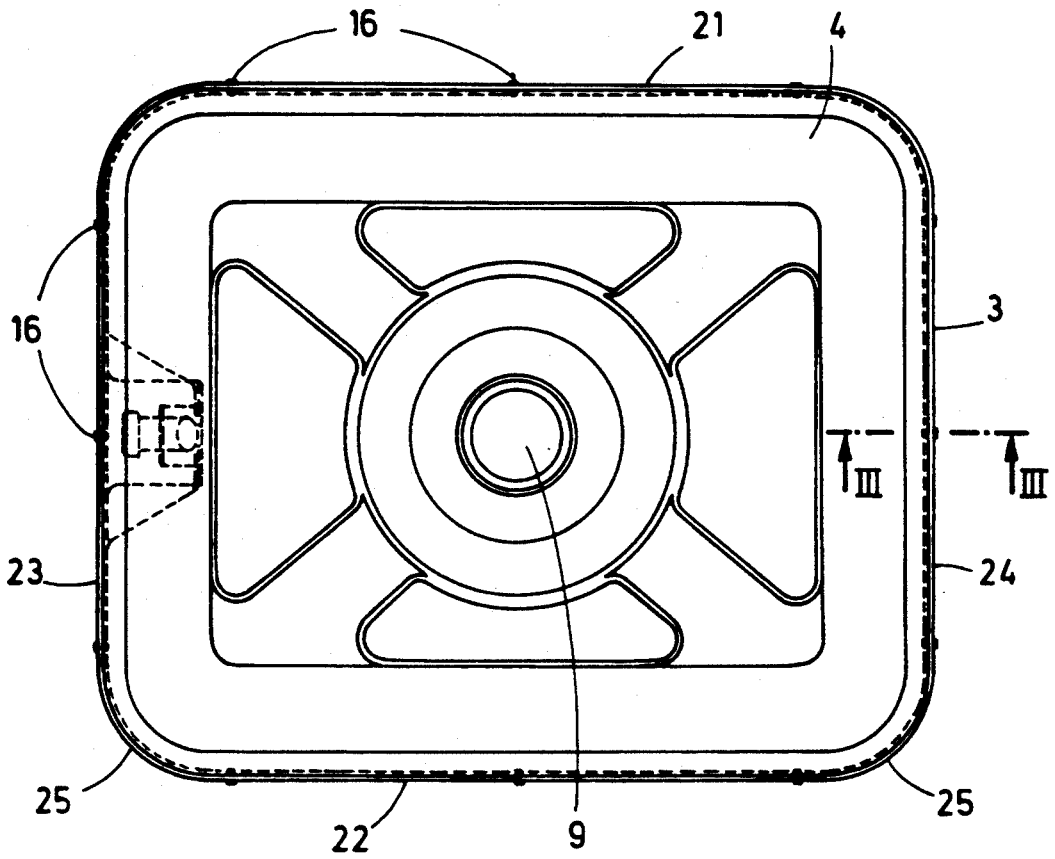
FIG. 2 is a top view of the pallet container of FIG. 1.
Figure 3:
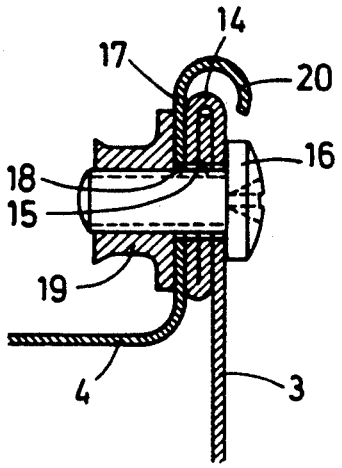
FIG. 3 shows an enlarged sectional view of he upper rim zone of the container along line III—III in FIG. 2.

The pallet container 1 according to FIGS. 1 and 2 comprises an inner container 2 blow-molded of a synthetic resin (polyethylene); this inner container is disposed in a sheet-metal casing made up of a sheet-metal jacket 3 in close contact with the inner container 2, with a lid 4 and a welded-on bottom 5. The pallet container furthermore comprises a flat pallet 6 of wood to which the sheet-metal jacket 3 is fixedly secured by threaded fasteners. The inner container 2 exhibits, in the center of its top surface 7, a filling opening 9 closable with a screw cap 8 and, on the end wall 10 in the bottom zone, an outlet opening 12 closable with a screw cap 11. The lid 4 and the sheet-metal jacket 3 are appropriately cut out in the zones of the filling opening 9 and outlet opening 12. The synthetic resin inner container 2 is supported by an elastic supporting shell 13 of a synthetic resin, this shell being arranged in a shape-mating fashion between the lower rounded rim of the inner container 2 and the sheet-metal jacket 3, as well as the bottom 5.

The upper, continuously extending rim of the sheet-metal jacket 3 is fashioned as a triple folded rim 14 produced by folding the upper jacket rim twice. The triple folded rim 14 exhibits punched-out slotted holes 15. For attaching the lid 4 to the sheet-metal jacket 3, cross-slotted screws 16 are utilized which penetrate the slotted holes 15 in the triple folded rim 14 and simple holes 18 in the upwardly extended rim 17 of the lid 4 lowered into the sheet-metal jacket 3, and are threaded into threaded sleeves 19 or nuts welded to the inner side of the lid rim 17.

The lid 4 covers the triple folded rim 14 of the sheet-metal jacket 3 with a rolled rim 20 formed on the upwardly extended rim 17.

During the production of the sheet-metal jacket 3 from a longitudinally welded tube on a stretching press, the structure of the sheet-metal material flows, on account of the stretching of the sidewalls 21, 22, of the end wall 23, and of the rear wall 24, in such a way that the rounded corners 25 of the sheet-metal jacket 3, consisting of galvanized steel sheet, form columns capable of carrying the weight of the pallet containers with contents stacked thereabove.

The exchanging of the synthetic resin inner container, required for using the pallet container as a multiple-trip container, can be performed simply and rapidly after loosening the lid screws and removal of the lid from the sheet-metal jacket.

What is claimed is:

1. In a pallet container of a synthetic resin for liquids, with respectively one closable filling opening and outlet opening, this container being surrounded by a carrying framework for stacking purposes, this framework consisting of a casing in close contact with the synthetic resin container and exhibiting a sheet-metal jacket with lid and a bottom, the casing being attached to a flat pallet, wherein cutouts in the casing permit access to the filling opening and outlet opening of the container; the improvement in which the upper rim of the sheet-metal jacket (3) is fashioned as a multiply folded rim, the lid (4) being removably secured to said rim by threaded fasteners.

2. Pallet container according to claim 1, wherein mounting screws (16) penetrate punched-out slotted holes (15) in the multiply folded rim (14) of the sheet-metal jacket (3) and simple holes (18) in the rim (17) of the lid (4), and are threaded into threaded sleeves (19) or nuts welded to the inside of the lid rim (17).

3. Pallet container according to claim 1, in which said multiply folded rim is a triple folded rim (14).

4. Pallet container according to claim 1, wherein said jacket rim is vertically disposed, said lid has an upstanding rim that is nested within said jacket rim, and said threaded fasteners pass through jacket rim and lid rim and hold said jacket rim and lid rim together.

5. Pallet container according to claim 4, in which said lid rim terminates in a rolled rim that extends laterally outwardly and then downwardly and overlies said jacket rim.

* * * * *